US007724197B1

(12) United States Patent
Hardie et al.

(10) Patent No.: US 7,724,197 B1
(45) Date of Patent: May 25, 2010

(54) WAVEGUIDE BEAM FORMING LENS WITH PER-PORT POWER DIVIDERS

(75) Inventors: George S. Hardie, Datil, NM (US); Michael J. Maybell, Mountain View, CA (US); Brian M. Cover, Scottsdale, AZ (US); Michael S. Davis, Longmont, CO (US)

(73) Assignee: Planet Earth Communications, LLC, Mountain View, CA (US)

( * ) Notice: Subject to any disclaimer, the term of this patent is extended or adjusted under 35 U.S.C. 154(b) by 525 days.

(21) Appl. No.: 11/799,595

(22) Filed: Apr. 30, 2007

(51) Int. Cl.
*H01Q 19/06* (2006.01)
*H01Q 15/02* (2006.01)
*H01Q 15/24* (2006.01)
*H01Q 13/00* (2006.01)

(52) U.S. Cl. ..... 343/754; 343/909; 343/776

(58) Field of Classification Search ..... 343/754, 343/753, 772, 776, 909
See application file for complete search history.

(56) References Cited

U.S. PATENT DOCUMENTS

| | | | | |
|---|---|---|---|---|
| 3,761,936 | A | 9/1973 | Archer et al. | |
| 3,979,754 | A | 9/1976 | Archer | |
| 4,490,723 | A | 12/1984 | Hardie et al. | |
| 4,641,144 | A * | 2/1987 | Prickett | 343/754 |
| 5,003,315 | A | 3/1991 | Skatvold et al. | |
| 5,677,697 | A | 10/1997 | Lee et al. | |
| 6,031,501 | A | 2/2000 | Rausch et al. | |
| 6,130,653 | A | 10/2000 | Powers et al. | |
| 7,042,420 | B2 | 5/2006 | Ebling et al. | |
| 7,518,566 | B2 * | 4/2009 | Schoebel | 343/772 |

OTHER PUBLICATIONS

"An Overview of Design and Analysis Techniques of Rotman Type Multiple Beam Forming Lens and Same Performance Results", Singhal, Sharma, Gupta; IE(I) Journal, vol. 84, Jan. 2004.
"Rotman Lens for mm-Wavelengths," Hall, Hansen, Abbots Proceedings of SPIE vol. 4935 (2002).

(Continued)

*Primary Examiner*—Shih-Chao Chen
(74) *Attorney, Agent, or Firm*—File-EE-Patents.com; Jay A. Chesavage

(57) ABSTRACT

A parallel plate beam forming lens is formed form at least three parallel plates, and includes a plurality of beam port waveguides, each coupled to a beam port divider with a step increase in waveguide height. The beam port divider comprises a first divider having two outputs separated by a resistive septum, each of which is coupled to a second divider having two outputs separated by a resistive septum, with all of the second divider outputs coupled to a lens region through beam port apertures. On the opposite end from the beam port waveguides is a plurality of array port waveguides forming a transformer, thereafter to a section of waveguide, and thereafter to an array port divider including a resistive septum coupled to the lens region and a step decrease in waveguide height. Also positioned at the extents of the beam port apertures and the array port apertures are a plurality of dummy ports. The beam port waveguides and array port waveguides are equalized in length using a feedthrough structure and a jog structure. The array port dividers, lens region, and beam port dividers are formed from the second and third plate, while the waveguides are formed from the first and second plate, with the feedthrough and jog structures formed on a combination of all three plates.

22 Claims, 10 Drawing Sheets

Waveguide Rotman Lens

OTHER PUBLICATIONS

"Analysis and Synthesis of Rotman Lenses", Simon, AIAA Int'l Communications Satellite Systems Couterance & Exibit May 9-12, 2004 (AIAA 2004-3196).

"Design and Simulation of a High Efficiency Rotman Lens for mm-Wave Collision Avoidance Sensor", Hall, Hansen, Abbott, Microelectronics Journal 33, (2002) 153-159.

* cited by examiner

Rotman Lens
Prior Art

Rotman lens parameters
Prior Art

Waveguide Rotman Lens

Beam/Array Port Waveguide modes

Lens modes

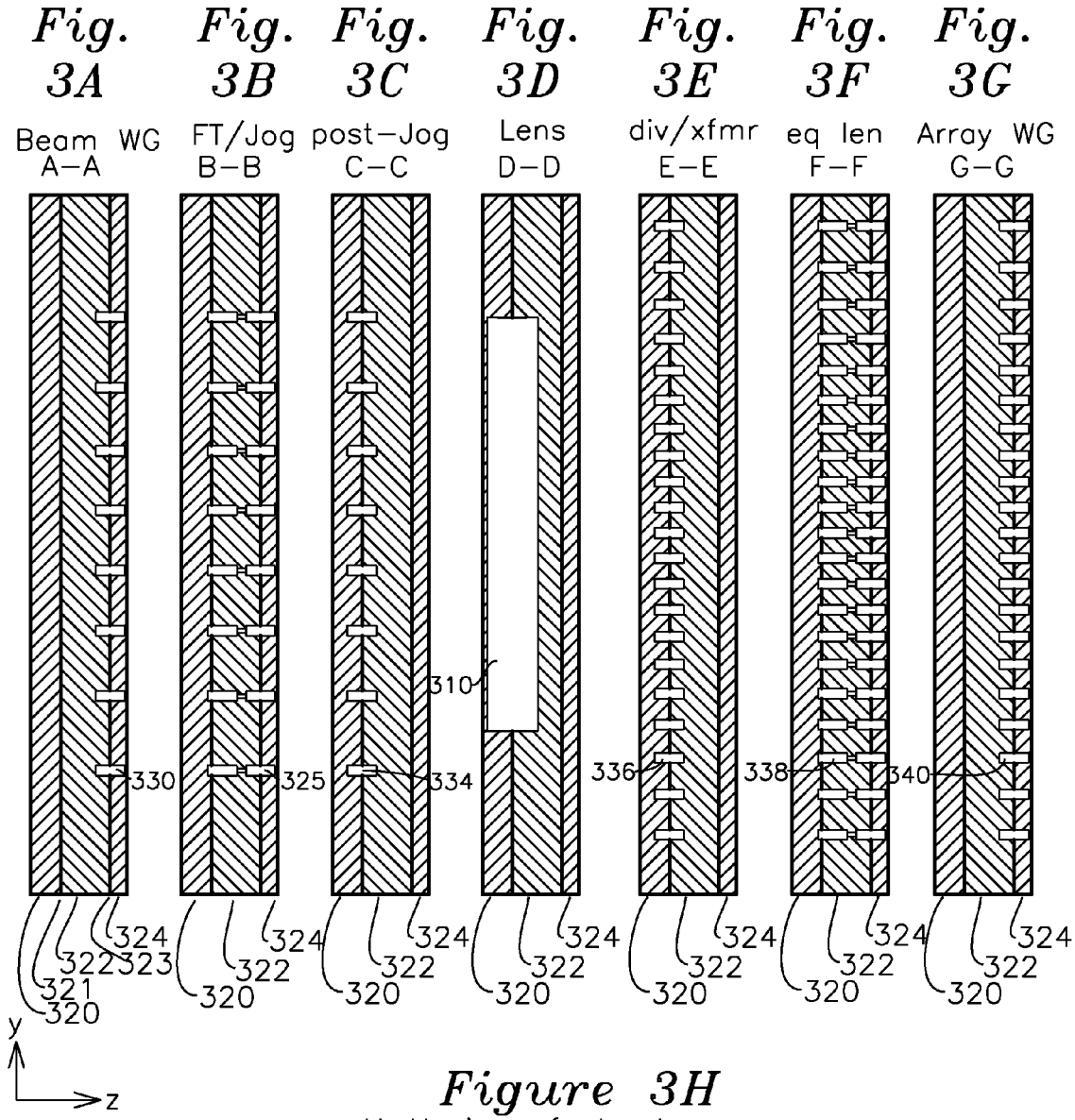
Figure 3H
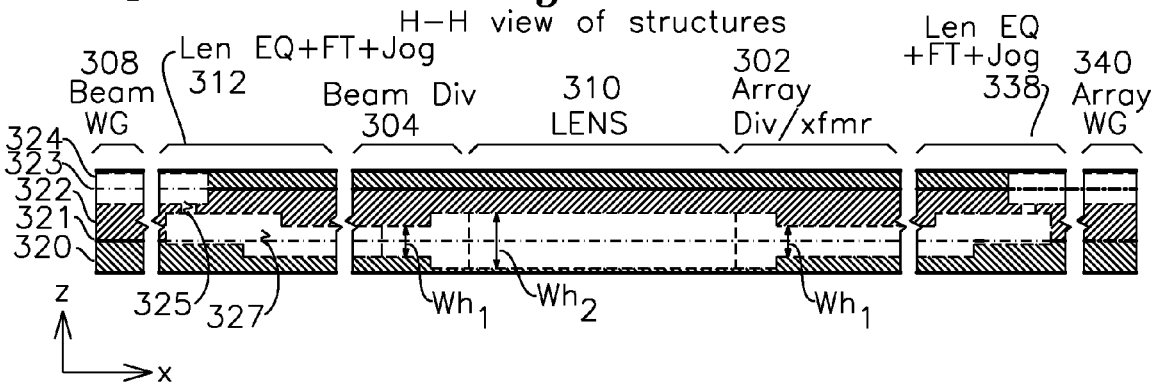

Array Port Detail–Top View

Array Port Detail–Section A–A

Array Port Detail–Section B–B

Power Divider/Combiner Detail

Beam Port Detail

Detail section C–C

Detail section D–D

Dummy (Termination) Port Detail

Detail section E–E

Detail section F–F

Dummy port termination detail

Detail section F–F

Detail section A–A

Detail section B–B

Detail section C–C

Detail section D–D

WAVEGUIDE BEAM FORMING LENS WITH PER-PORT POWER DIVIDERS

This invention was made with Government support under contract FA9453-05-C-0033 awarded by the United States Department of Defense. The Government has certain rights in this invention.

FIELD OF THE INVENTION

The present invention relates to a parallel plate waveguide beam forming lens, also known as a Rotman lens. In particular the present invention is related to a low loss beam forming lens for use in an antenna system for producing a number of simultaneously existing beams, where the system incorporates a parallel plate lens cavity filled with vacuum, air or other near homogeneous isotropic dielectric for electromagnetic energy propagating in the TE mode.

BACKGROUND OF THE INVENTION

FIG. 1 shows a prior art Rotman lens 100, which includes a plurality of equal-length waveguide beam ports 102-1 through **102-*n*, which couple to parallel plate lens apertures 108-1 through 108-*n*, respectively. On the opposing side of the parallel plate lens region 114 are a plurality of waveguide apertures 110-1 through 110-*m*, which are coupled to array port waveguides 104-1 through 104-*m* which also incorporate the Rotman W parameters, which are incremental per-port delays added to the array port waveguides. Dummy ports 112-1 through 112-*p* and 106-1 through 106-*p* couple unusable wave energy which enters from the parallel plate lens region 114 into termination cavities, which minimize wave energy reflected into the parallel plate lens region 114. The beam forming lens 100 may be used bi-directionally, such that for one exemplar transmit application, waveguide RF from a transmitter (not shown) is applied to a power splitter (not shown) and thereafter to a plurality of waveguides and applied to beam port waveguides 102-1 through 102-*n*, through lens region 114 and waveguide array ports 104-1 through 104-*m* and thereafter to a transmit antenna. In one examplar receive application, incoming antenna energy is coupled to waveguide array ports 104-1 through 104-*m*, through parallel plate lens region 114, through waveguide beam ports 102-1 through 102-*m***, summed (not shown), and delivered to a microwave receiver (not shown).

In an embodiment of the prior art such as U.S. Pat. No. 4,490,723, the Rotman lens 100 of FIG. 1 may be realized using stripline or microstrip conductors, whereby one or more RF conductors are separated by a substrate material having a dielectric constant. Stripline and microstrip transmission lines and lens structures propagate waves in the transverse electromagnetic (TEM) mode. The TEM mode has a phase velocity that is essentially constant with frequency, which results in a formed beam which is largely frequency invariant, which results in the property known as minimum frequency scan, or minimum variation of the formed beam angle with frequency. Prior art U.S. Pat. No. 4,490,723 is one example of this construction. At high operating frequencies, several problems emerge when using stripline or microstrip Rotman lens structures. A first problem is the finite thickness of the dielectric substrate allows the transmission lines formed over the substrate to support higher order wave modes, and the higher order modes propagate at a different phase velocity than the desired TEM mode, thereby causing interference with the desired TEM mode and undesired sidelobes in the radiation pattern. For best performance, the dielectric thickness should be less than 0.1 wavelengths in the dielectric. For example, at an operating frequency of 45.5 Ghz, a wavelength in vacuum is 0.259 inches, which results in a vacuum dielectric thickness of 0.026 inch, and for most substrate dielectrics which have a dielectric constant of approximately 2.2 such as PTFE (Poly-TetraFluoroEthylene), a thickness on the order of 0.017 inch, which results in a substrate dielectric structure with undesirably tight feature and etching tolerances. Additionally, many dielectric materials have undesirable mode dependant dielectric constants, and also wave propagation dependant dielectric constants, where in the lens region of a Rotman lens structure, the dielectric constant may depend on the angle of propagation across the planar surface of the lens region.

An alternative to fabricating the Rotman Lens 100 in stripline or microstrip structure is to use a closed waveguide with an air or other dielectric, such as U.S. Pat. No. 6,031,501. The advantage of a waveguide structure is the beam and array waveguides and associated lens structures may be significantly larger and easy to machine and manufacture compared to stripline or microstrip structures, however waveguides support TE modes, and cannot support TEM wave modes. Of the TE modes, TE10 is the lowest mode that can propagate in a rectangular waveguide. For the TE10 mode, the phase velocity Vp is:

$$Vp = \frac{c}{\sqrt{1-\left(\frac{\lambda}{2W_h}\right)^2}}$$

Where:

c=velocity of light;

$\lambda$ is the free space wavelength

Wh is the height of the waveguide

As can be seen from the formula above, Vp is a function of wavelength $\lambda$, which introduces a frequency dependant phase delay producing the result known as frequency scan. The effect of wavelength on Vp can be reduced by maximizing Wh, but this also allows higher mode TE waves to propagate through the waveguide. The TE10 mode is supported by a waveguide with a height Wh of $\lambda/2$, TE20 is additionally supported by a waveguide with a height Wh of $\lambda$, and TE30 mode is additionally supported when the waveguide height Wh is $3\lambda/2$. It is desired to maximize waveguide height Wh in the lens region, thereby reducing frequency dependant phase velocity which causes frequency scan, while also minimizing the higher modes supported as a consequence of increased Wh. Another desirable outcome of increasing the waveguide height Wh is reduced lens insertion loss.

FIG. 2 shows the geometry of a Rotman lens including lens parameters, which include the four basic lens parameters $\alpha$, $\beta$, f1, $\gamma$, where $\alpha$ is the focal angle shown in FIG. 1;

$\beta$ is the focal ratio f2/f1 of FIG. 1;

$\gamma$ is the expansion factor ($\sin\psi/\sin\alpha$).

As derived by Hansen, the normalized length W=w/f1 of the waveguide attached to the array element at y=y3 where w is the length of the transmission line to the array port satisfies the following quadratic equation:

$$aW^2+bW+c=0$$

with coefficients a,b,c defined by:

$$a = 1 - \frac{(1-\beta)^2}{(1-\beta\cos\alpha)^2} - \frac{\xi^2}{\beta^2}$$

$$b = -2 + \frac{2\xi^2}{\beta} + \frac{2(1-\beta)}{1-\beta\cos\alpha} - \frac{\xi^2\sin^2\alpha(1-\beta)}{(1-\beta\cos\alpha)^2}$$

$$c = -\xi^2 + \frac{\xi^2\sin^2\alpha}{1-\beta\cos\alpha} - \frac{\xi^4\sin^4\alpha}{4(1-\beta\cos\alpha)^2}$$

$$\text{with } \xi = \frac{y_3\gamma}{f_1}$$

Solving for W for each array port results in a per-array port W distance shown as 202, 204, 206, 208, each of which is computed from the above formulas based on x,y position, and is added to the equal length array port waveguide to arrive at the overall length for each waveguide 104-1 through **104-*m* of FIG. 1**.

PRIOR ART

U.S. Pat. Nos. 4,490,723 and 3,761,936 describe a Rotman lens of stripline construction, whereby a plurality of array ports is coupled to a plurality of beam ports on opposite sides of a lens region, where all of the components are formed from stripline conductors fabricated on printed circuit boards.

U.S. Pat. No. 6,130,653 describes a stripline Rotman lens using trace delay equalization of the inner ports compared to the outer ports.

U.S. Pat. No. 5,677,697 describes a system for controlling the beam scan on a Rotman lens using phase heterodyning.

U.S. Pat. No. 5,003,315 describes a lens feed transmission line for varying the feed lengths to the ports of a Rotman lens.

U.S. Pat. No. 6,031,501 describes a waveguide beam forming lens which includes power dividers and combiners which also provide for λ/2 port aperture spacings.

OBJECTS OF THE INVENTION

A first object of this invention is a beam forming lens having substantially frequency independent beam pointing angles and low internal losses, the beam forming lens having a plurality of beam ports, each beam port having a power divider for coupling energy from a waveguide to a plurality of beam port apertures and thereafter into a lens region, where the lens region has a waveguide height Wh2 greater than 1.8 times that of the waveguide height Wh1, whereby on the opposite side of the lens region, the power is coupled into a plurality of array ports apertures, the array port apertures coupling power from an adjacent pair of array port apertures into an array port waveguide using an array port combiner and transformer, the beam forming lens also having a plurality of dummy ports coupled to a parallel plate lens region and positioned between the plurality of beam port apertures and array port apertures.

A second object of the invention is a parallel plate beam forming lens formed from a first and second plate having a first planar surface therebetween, the first and second plate forming beam port waveguides substantially centered about the common first and second plate planar surface, where a second planar surface is formed opposite the second plate planar surface and adjacent to a third parallel plate, where the first, second, and third plates form a feedthrough waveguide which is coupled to a jog waveguide that is centered about the second planar surface, the jog waveguide thereafter coupled to a beam port divider coupling power through beam divider apertures into a lens region, the opposite side of which is coupled to a plurality of array port apertures which sum power into an array port waveguide. The lens region also has dummy ports positioned between the plurality of beam port apertures and array port apertures. The beam port divider and apertures, lens region, array port dividers and apertures, dummy ports, and array port waveguides are positioned symmetrically about the second and third parallel plate second planar surface, whereas the beam port waveguides are positioned symmetrically about the first and second parallel plate first planar surface.

A third object of the invention is an array port power divider/combiner which couples efficiently to a waveguide and produces improved radiation patterns inside of a lens region, the array port power divider/combiner including an array port waveguide input having a first height, an array port divider including a matching region with increasing waveguide height steps to a second height, an array port septum having a resistive surface and the second height, and array port waveguide outputs having a second height.

A fourth object of the invention is a beam port power divider/combiner which couples efficiently to a waveguide and produces improved radiation patterns inside of a lens region, the beam port power divider including a beam port waveguide input having a multi-stage divider, the multi-stage divider having a first divider including a first divider waveguide input, a first divider resistive septum, and a pair of first divider outputs, each first divider output coupled to a second divider including a second divider waveguide input, a second divider resistive septum, and a pair of second divider outputs, whereby the second divider outputs have apertures which are adjacent to the parallel plate lens region.

A fifth object of the invention is a feedthrough waveguide structure for coupling power from a first waveguide to a second waveguide through an aperture positioned between the first and second waveguide.

SUMMARY OF THE INVENTION

In a first embodiment of the invention, a waveguide beam forming lens is formed from a first plurality of substantially uniform length beam port waveguides, each of which is coupled to a beam port divider which comprises a first divider including a vertical resistive septum which is coupled to first divider outputs, each first divider output coupled to a second divider including a vertical resistive septum forming a pair of output waveguides leading to the parallel plate lens region. Opposite the beam port waveguides are the array port waveguides which include uniform length waveguides individually modified by the Rotman W values described earlier, each of which are coupled to an array port divider, each array port divider comprising a waveguide height increase forming a transformer, a vertical septum having a resistive surface, and a pair of array port divider output waveguides which terminate into the parallel plate lens region. Dummy ports are placed between the contiguous ports of the array port apertures and contiguous ports of the beam port apertures, and each dummy port comprises a waveguide with height Wh2 having an aperture leading to the parallel plate lens region which also has a height Wh2, the aperture including a termination having a first resistor and a second resistor, each resistor formed from substrate having a surface film of resistive material deposited on one side, the first and second resistors placed substantially parallel to the plates of the parallel plate lens region with separations from each other and the parallel plates so as to attenuate both TE20 and TE10 modes.

In a second embodiment of the invention, a beam forming lens comprises a lens region, beam port dividers having a first divider and a pair of second dividers with apertures coupled to the lens region, feedthough and jog waveguides for creating equal-length beam port waveguides, array port dividers having apertures also coupled to the lens region, and array port waveguides for creating equal length beam port waveguides. The structures are formed from a first substantially planar plate, which is placed adjacent to a second plate and having a first substantially planar contact surface, and a third substantially planar plate is placed adjacent to the opposite side of the second plate, thereby creating a second substantially planar surface. The first and second plates are used to form the beam waveguides, and the first, second, and third plates are used to form the feedthrough waveguides. The beam port dividers, lens region, and array port dividers are formed symmetrically about the second planar contact surface.

BRIEF DESCRIPTION OF THE DRAWINGS

FIGS. 3A, 3B, 3C, 3D, 3E, 3F, 3G, 3H, 3I and 3J show various section views of the beam forming lens of FIG. 3.

DETAILED DESCRIPTION OF THE INVENTION

In the discussion of the prior art, an increased waveguide height Wh resulted in reduced phase velocity dependence on frequency, which reduces undesired frequency scan, however this increased waveguide height Wh comes at the expense of introducing higher order modes into the lens and waveguide regions which would share this same Wh dimension. The higher order modes represent power loss and increased sidelobes in the resulting radiation pattern. It is desired to increase Wh to the largest practical value in the lens region to minimize frequency scan and decrease insertion loss while minimizing the generation of higher order modes supported by the increased Wh. In the present invention of FIG. 3, the lens region has a Wh2 dimension which is selected to be just below the TE30 mode cutoff Wh2, thereby suppressing TE30 modes. The lens height Wh then supports only TE10 and TE20 modes, and the reflected TE20 modes in the lens region 310 are suppressed via dummy ports 306, which have a resistive planar film placed in a region which preferentially attenuates TE20 mode compared to TE10 but attenuates both modes. Wh is stepped from a lens height Wh2 which supports TE10 and TE20 but does not support TE30, down to a height Wh1 which only supports TE10 in the beam port aperture region and in the array port divider region. Waveguide regions 330 and 336 have a waveguide height Wh1 which supports only TE10 mode, and the height of the waveguide Wh2 in the lens region 310 is increased to more than 1.8*Wh1. By carefully coupling power from the waveguides 330, 336 having Wh1 to the lens region 310 having larger Wh2, and by adding dummy ports with special terminations suitable for attenuation and absorption of TE20 modes, a beam forming lens with reduced frequency scan reduced insertion loss and reduced reflected high-order lens modes can be realized.

Figure 3:
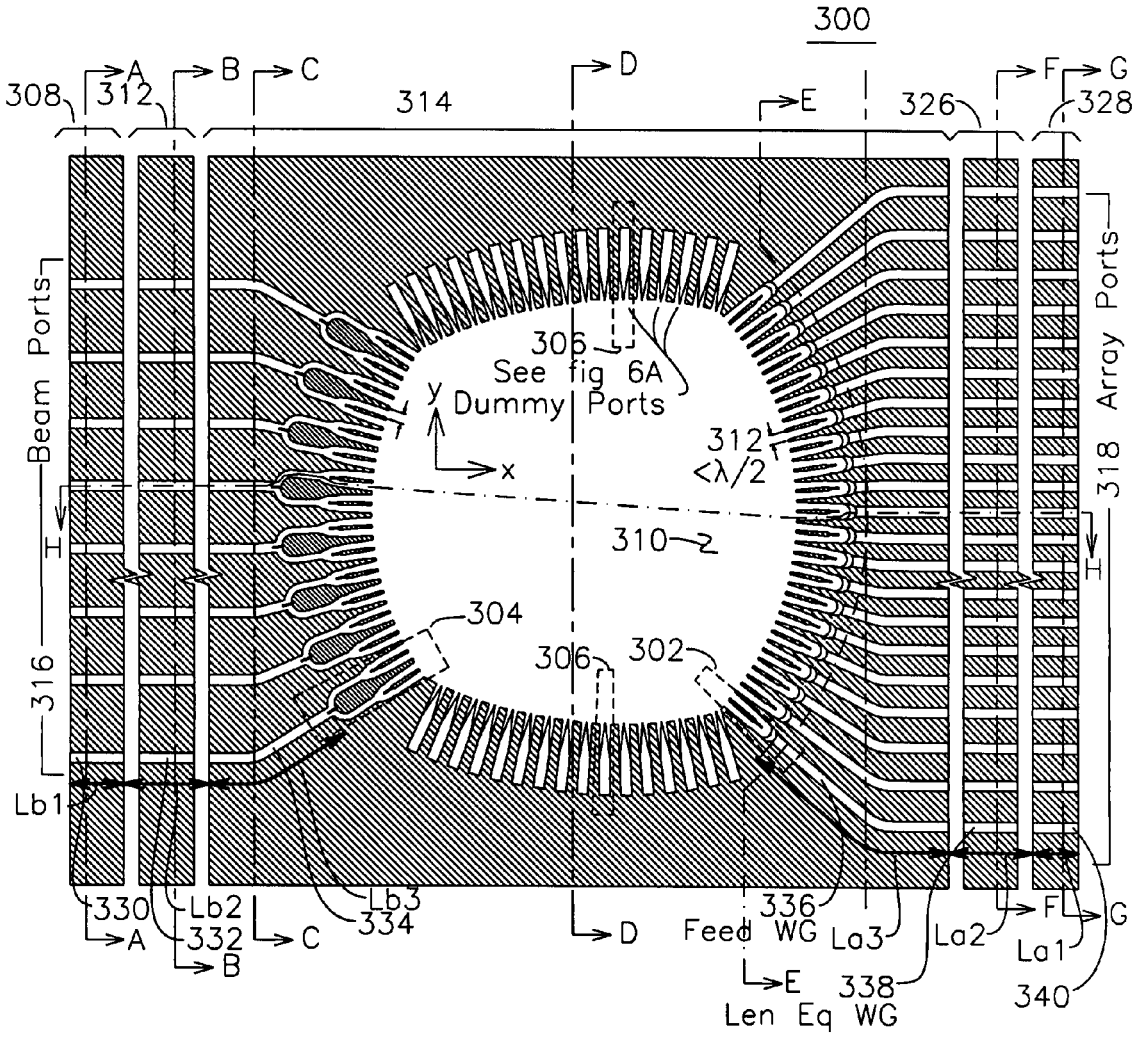
FIG. 3 shows a waveguide beam forming lens of the present invention.

FIG. 3 shows an embodiment of the waveguide beam forming lens 300 of the present invention, which includes beam ports 316, each of which is coupled to a beam port waveguide 330 in waveguide region 308, which is thereafter coupled to a feed-through structure and offset jog waveguide region 312 prior to being fed to beam port divider 304, as will be discussed later, where the beam port divider 304 comprises a multi-level power divider which separates the incoming waveguide power into four adjacent beam port apertures opening into the parallel plate lens region 310. On the opposite end of the beam ports 316 and parallel plate lens 310 are array ports 318, where the array ports 318 each have waveguides 340 which feed into a waveguide path equalizer region 326 having waveguide feedthroughs and jogs, and thereafter into an array port divider 302 which has apertures opening into the lens region 310. The array port divider 302 comprises a transformer formed from a change in height of the array port waveguide in the z axis (perpendicular to the parallel plates) after which an array port divider provides power to an adjacent pair of array port apertures in the lens region. The beam port divider 304 comprises a first divider which uses a conductive or resistive septum to convert a single first port common to the waveguide into two second ports, where each second port feeds a second divider, and each second divider similarly has a first port and a pair of second ports, where the second divider first port is coupled to the first divider second port, and each second divider second port has an output aperture coupled to the parallel plate lens region. In this manner, each beam port waveguide 330 is coupled to four beam port apertures which are adjacent to each other. The beam forming lens 300 also includes a plurality of dummy ports 306, which are placed between the continuous series of array port apertures and continuous series of beam port apertures. An additional feature of the lens of FIG. 3 is that the paths through each beam port waveguide 330 to each beam port divider 304 has as components a wavelength length Lb1, a feedthrough and jog waveguide length Lb2, and a lens waveguide length Lb3, and it is desired to make the sum Lb1+Lb2+Lb3 equal across all waveguide regions by varying path length Lb2. This is accomplished using a set of serpentine folds and bends (not shown) in feedthrough and jog waveguide region 312. Similarly, it is desired to form each of the array port waveguides such as 340, 338, and 336 such that the array port waveguide length sum La1+La2+La3 is equal across all array ports, and where the per-port incremental waveguide length governed by the Rotman waveguide length (Rotman W) parameter is preferably provided by array port divider 302 structure, or alternatively incorporated into the waveguide 336, 338, or 360 length.

Figure 3I:
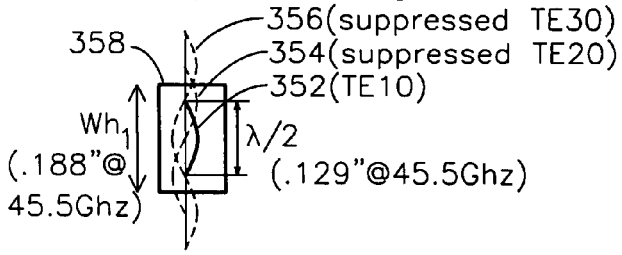
Figure 3J:
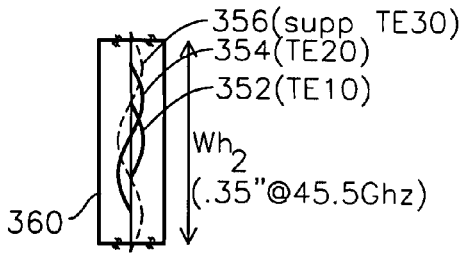

FIG. 3I shows a beam port or array port waveguide with the different TE modes also included for reference. Each TE mode requires an additional lambda/2 in waveguide height Wh, and if the physical dimension of Wh is less than that required to support this particular mode, the mode is fully suppressed and does not propagate. Waveguide 358 has a height Wh1, shown in the example as 0.188" for 45.5 Ghz operation. Since TE10 has a lambda/2 dimension of approximately 0.129" at 45.5 Ghz, waveguide 358 will only support TE10 mode 352, and the higher modes TE20 354 and TE30 356 are suppressed. FIG. 3J shows the lens region 360, which has an increased height of Wh2, shown as 0.35" at 45.5 Ghz. This value of Wh2 is sufficient to support TE10 352 and TE20 354, but is selected to be inadequate to support TE30. In this manner, the waveguide height Wh is selected to provide support exclusively for TE10.

FIGS. 3A through 3H show various cross section views corresponding to sections A-A through H-H, respectively, of FIG. 3, which are intended to show one particular way of fabricating a beam forming lens of the present invention using a top or first plate 324, a middle or second plate 322, and a bottom or third plate 320, each plate being substantially parallel and having a substantially planer first contact surface 323 and a substantially planar second contact surface 321. The structures of the beam forming lens are positioned such that they may be formed by machining features into each plate, and the structures are completed in form when the plates are placed in contact across the first contact surface 323 and second contact surface 321, as shown in FIGS. 3A through 3H. FIGS. 3A and 3H show different views of a cross section of the beam port waveguides 330 in region 308 of FIG. 3, which are formed symmetrically on the shared first surface 323 of first parallel plate 324 and second parallel plate 322. FIG. 3B shows a cross section view of a feedthrough waveguide 325 formed on first plate 324, second plate 322, and third plate 320, followed by a jog waveguide 327 shown in FIG. 3H formed form the second plate 322 and third plate 320 in region 312, each structure of which enables microwave energy to couple from one nominal z axis position to another with minimum loss and reflection. FIG. 3C shows the output of the jog waveguide 334 centered about the second contact surface 321 of the second parallel plate 322 and the third parallel plate 320. The beam port divider 304 of FIG. 3H includes an aperture which couples energy to parallel plate lens region 310 shown in FIG. 3D, which is formed from the second parallel plate 322 and third parallel plate 320. FIG. 3E shows the outputs of the array port divider/transformer 304 with reduced waveguide 336 height Wh in region 336. FIG. 3F shows the feedthrough waveguides in the region where waveguide paths are used as in the prior art to equalize the waveguide length sum La1+La2+La3 of FIG. 3 by selecting La2, and FIG. 3G shows the beam port waveguides 340 at the exit point of the beam forming lens structure 300. FIG. 3H follows a section H-H of the structure which follows the waveguide and lens structures continuously for clarity, rather than in planar section. FIG. 3H thereby shows the parallel plate construction and z-axis structure for, in sequence, the beam waveguide 308, feedthrough 325, jog waveguide 327, beam port divider 304, parallel plate lens region 310, array port divider and transformer 302, array port jog and feedthrough section 338 including length equalization, and array port waveguide 340.

Figure 1:
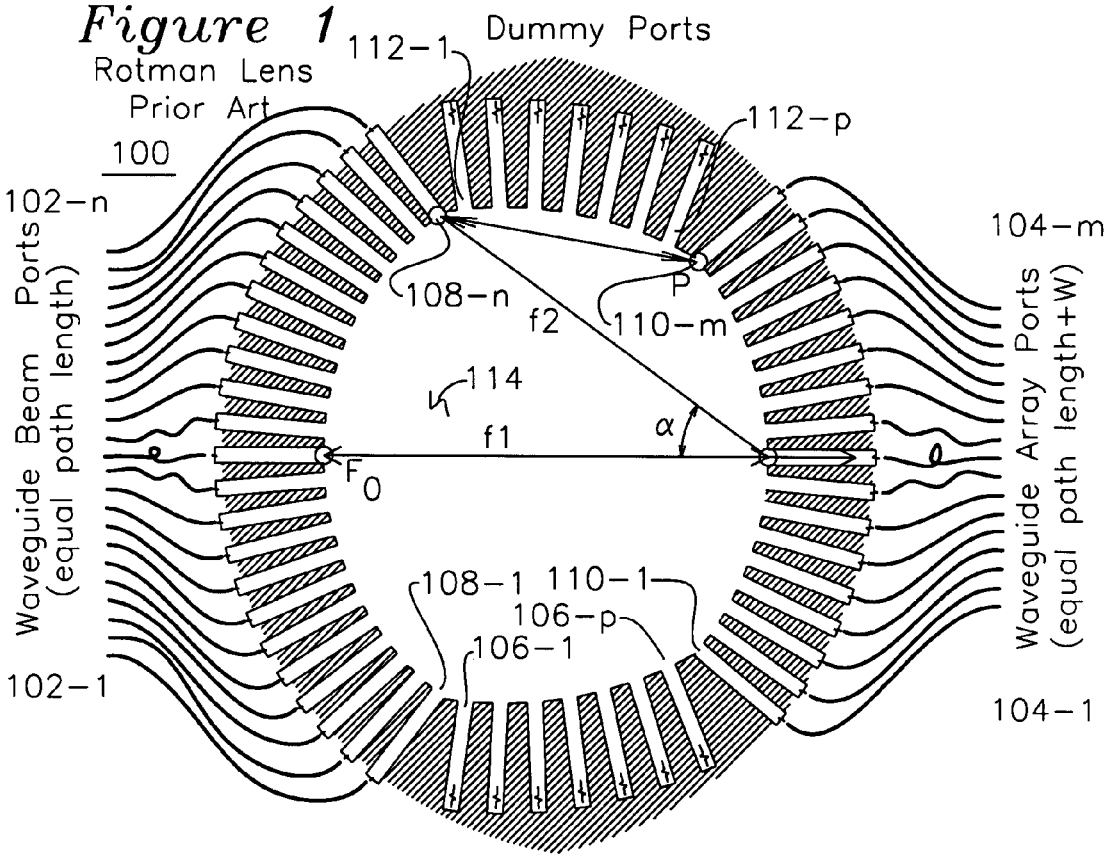
FIG. 1 is a top view of a prior art Rotman lens microwave device.
Figure 2:
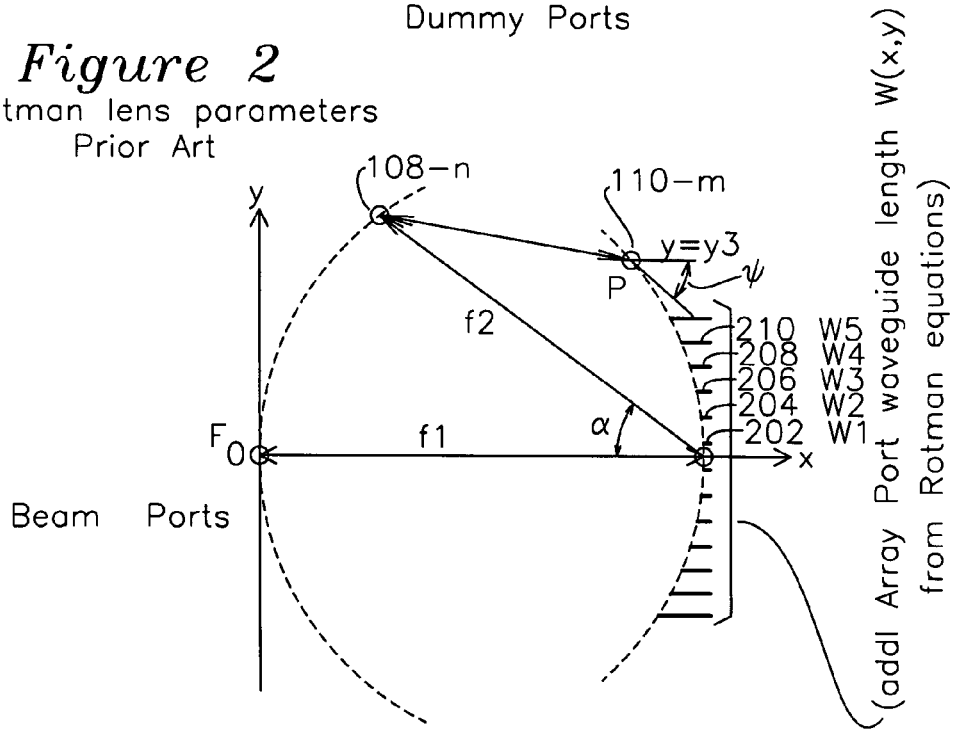
FIG. 2 shows the geometrical construction constraints of a Rotman lens.
Figure 4A:
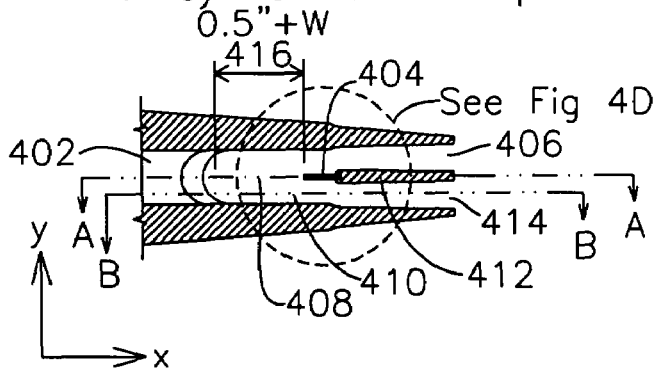
FIG. 4A shows the top view of an array port of FIG. 3.
Figure 4B:
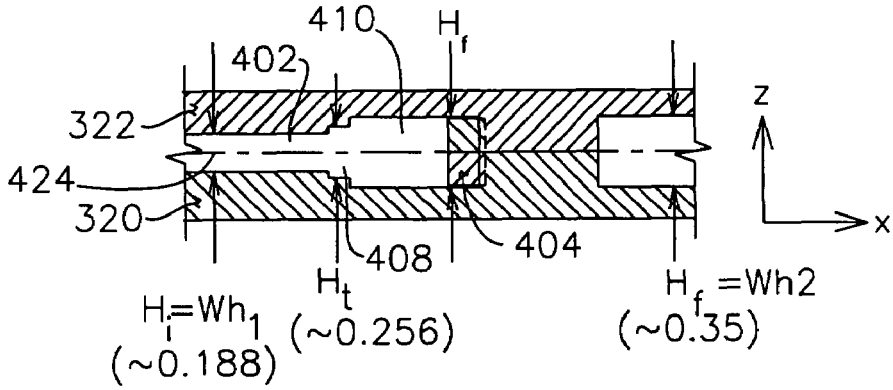
FIG. 4B shows a section view of FIG. 4A.
Figure 4C:
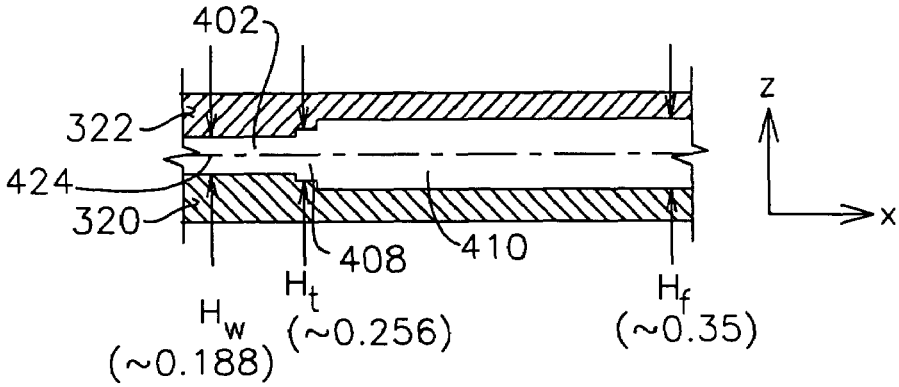
FIG. 4C shows a section view of FIG. 4A.
Figure 4D:
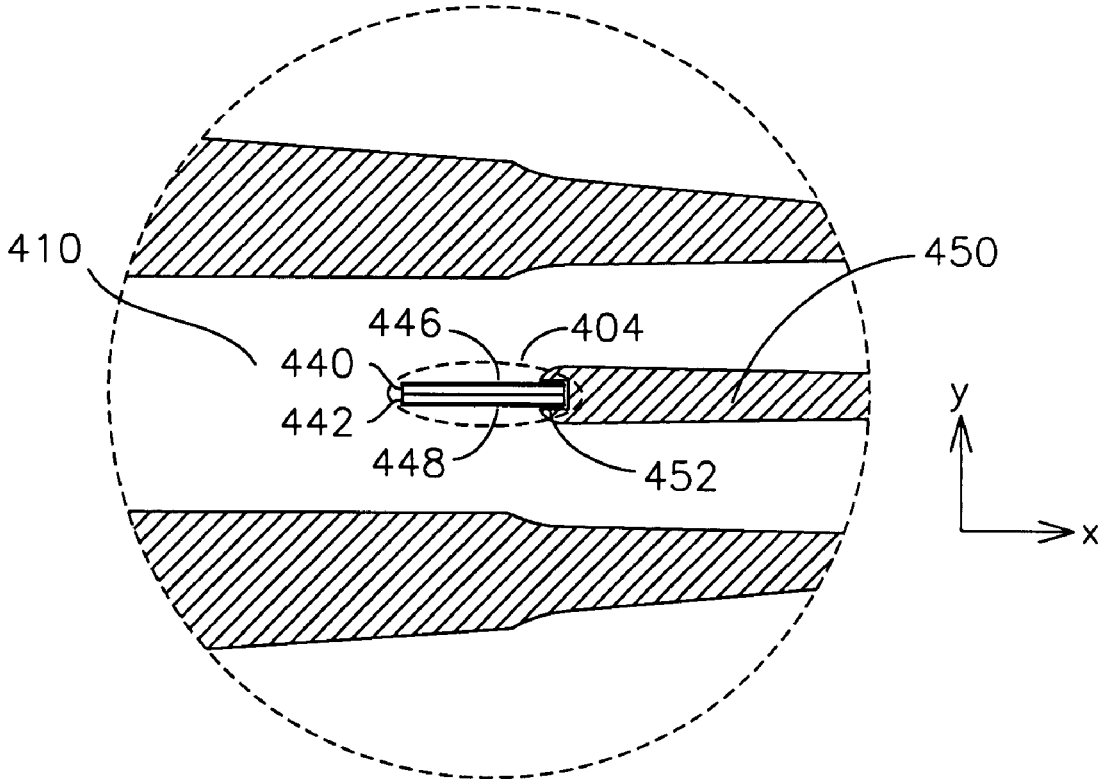
FIG. 4D shows a detail view of FIG. 4A.

A single array port divider 302 of FIG. 3 is shown in detailed top view FIG. 4A, where the array port waveguide 402 encounters a transformer, or impedance matching network comprising a first transition step height change 408 to Ht and then to a final lens height change Hf 410 in the direction of propagation of waveguide 402, followed by a separation 416 of a fixed value such as 0.5 inches plus the per-port Rotman W value described in FIG. 2 and preceding equations. This is followed by resistive septum 404 which couples power into the parallel plate lens region via array port apertures 406 and 414. FIG. 4B shows section A-A of FIG. 4A, including a transformer where the waveguide 402 has a first height such as Hw of 0.188 inch, a transition height Ht of 0.256 inch, and a final height Hf of 0.35 inch. These heights correspond to best performance for EHF-band microwave TE mode waves in the range of 40 GHz-50 GHz. FIG. 4C shows the array port cross section B-B of FIG. 4A, where the section includes the array port waveguide 402, step transition 408, and array port final region 410. FIG. 4D shows additional detail of the resistive septum 404 of FIGS. 4A and 4B. The resistive septum 404 of FIG. 4D is formed from a first substrate 440 with resistive surface 446 interacting with propagating waves and second substrate 442 with resistive surface 448 on the opposite side, also interacting with propagating waves in the waveguide. The septum 404 is fitted into a slot 452 in first divider output waveguide structure 450. Adjacent to first septum 404 are also shown waveguide 402, transition step 408, and final step 410.

Figure 5A:
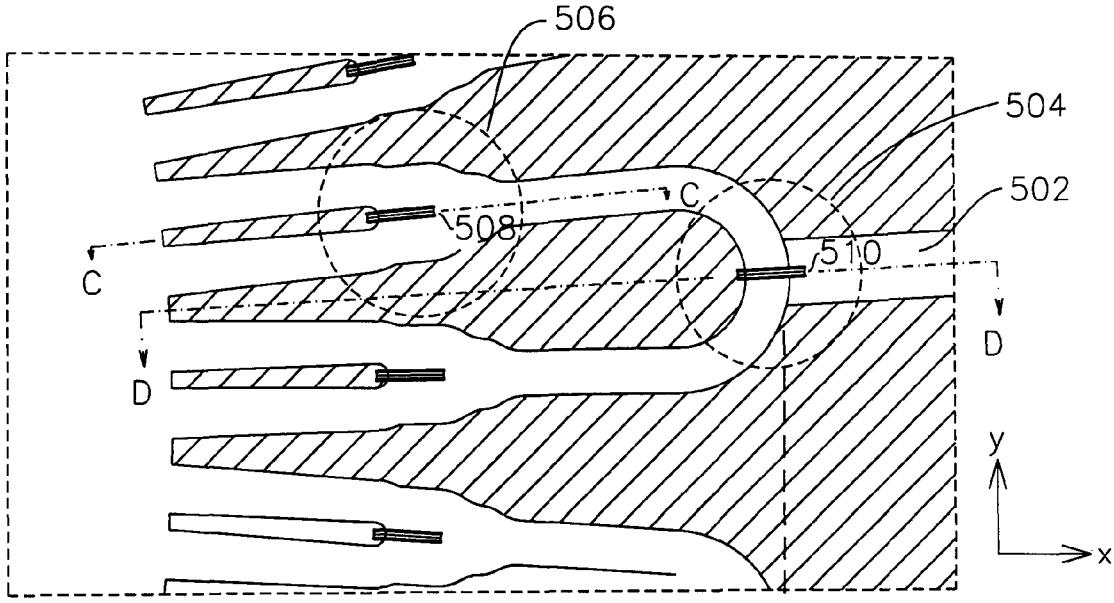
FIG. 5A shows the top view of a beam port of FIG. 3.
Figure 5B:
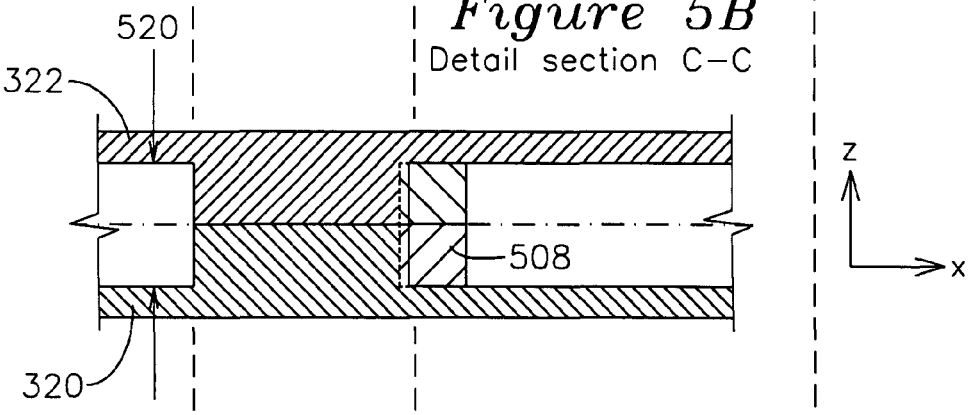
FIG. 5B shows a section view of FIG. 5A.
Figure 5C:
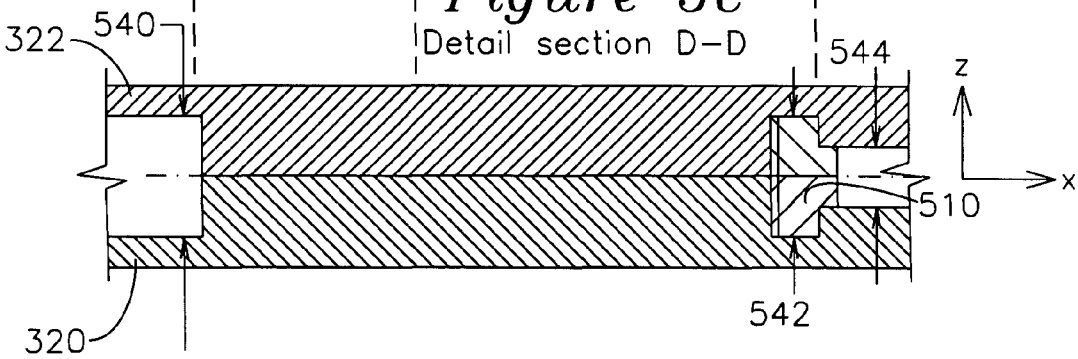
FIG. 5C shows a section view of FIG. 5A.

FIG. 5A shows the detail of a beam port such as 304 of FIG. 3. Beam port waveguide 502 leads to first divider 504, which includes a resistive septum 510 fabricated from a first and second substrate, each with a resistive coating placed on opposite surfaces, as was previously described for the array port waveguide. Section D-D of FIG. 5A, shown in FIG. 5C details first divider 504, which includes a step change from a waveguide height 544 of 0.188 to a final height 542 of 0.375, and the first divider septum 510 also follows this step change in height. Each output from the first divider is coupled to a pair of second dividers, one of which is shown as 506, and includes an input waveguide of final height, a septum 508 formed from a pair of substrates, each having a resistive surface placed on opposing surfaces, as was described earlier.

Figure 6A:
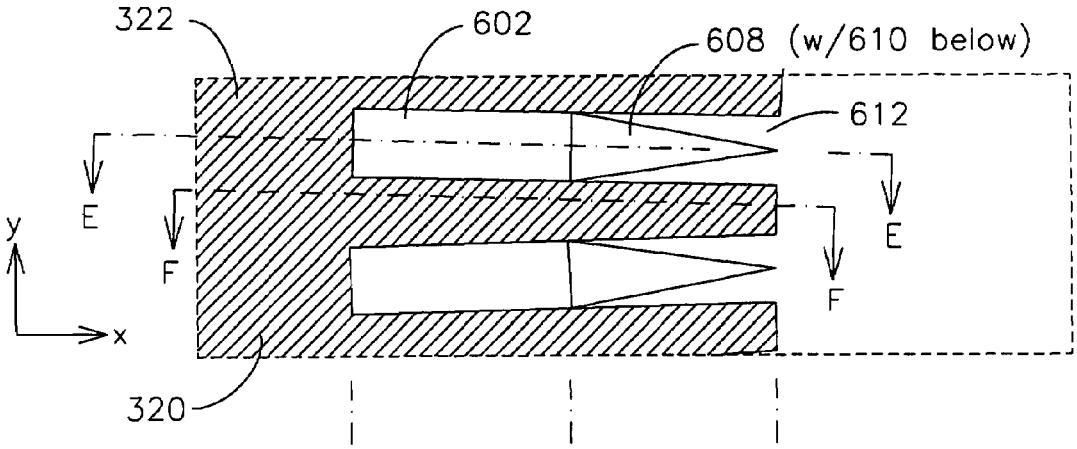
FIG. 6A shows the top view of a dummy port of FIG. 3.
Figure 6B:
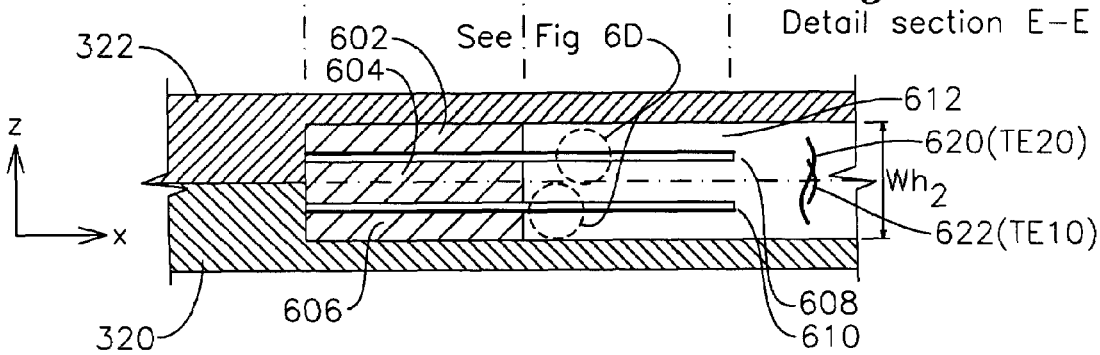
FIG. 6B shows a section view of FIG. 6A.
Figure 6C:
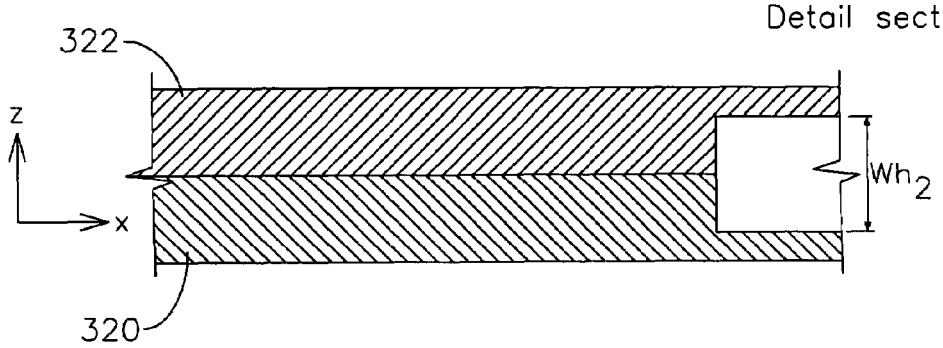
FIG. 6C shows a section view of FIG. 6A.
Figure 6D:
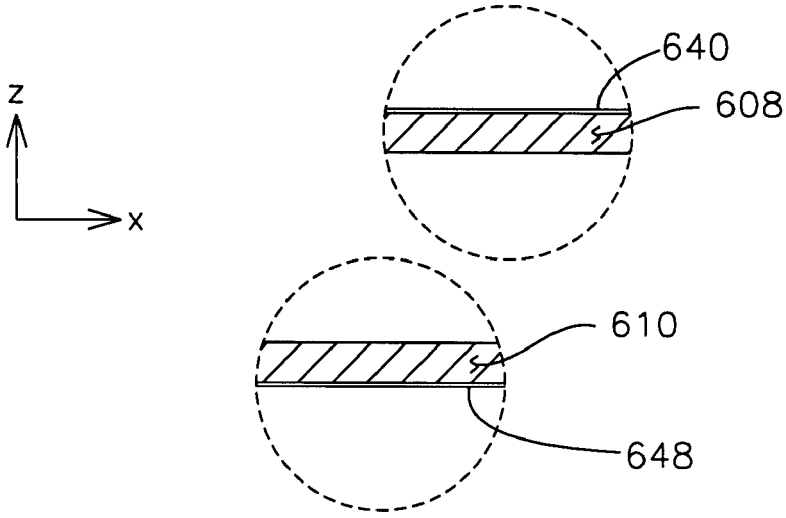
FIG. 6D shows a detail view of FIG. 6A.

FIG. 6A shows a dummy port such as 306 of FIG. 3. The dummy port comprises an aperture 612 which is common to the parallel plate lens region 310 of FIG. 3, with each aperture having a first resistive wedge 608 and a second resistive wedge 610 placed at approximately ⅓ of the waveguide height from each parallel plate surface. In the preferred mode, the first resistor 608 and second resistor 610 are placed at z-axis heights which result in maximum attenuation for TE20 mode 620 compared to TE10 mode 622, such as shown at the maximum amplitude points of TE20 620. This preferential attenuation of TE20 over TE10 may be realized by a separation distance from each resistor to the adjacent lens surface which ranges from ⅛*Wh2 to ⅓*Wh2. The wedges 608 and 610 are supported in place by insulators 602, 604, and 606. The resistive wedges 608 and 610 are fabricated from a substrate material with a resistive surface applied to one side, as shown in resistive deposition coating 640 applied to wedge 608 and resistive deposition coating 648 applied to wedge 610 of detail FIG. 6D.

Figure 7:
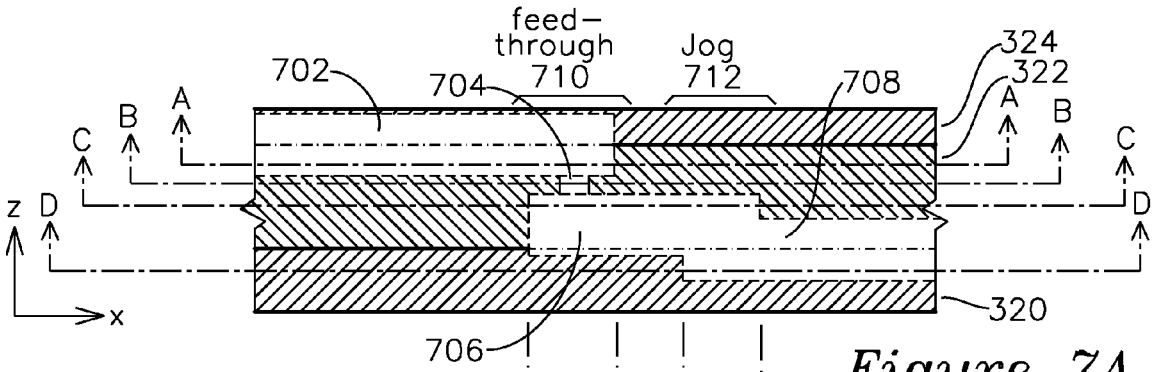
FIG. 7 shows a jog feedthrough waveguide.
Figure 7A:
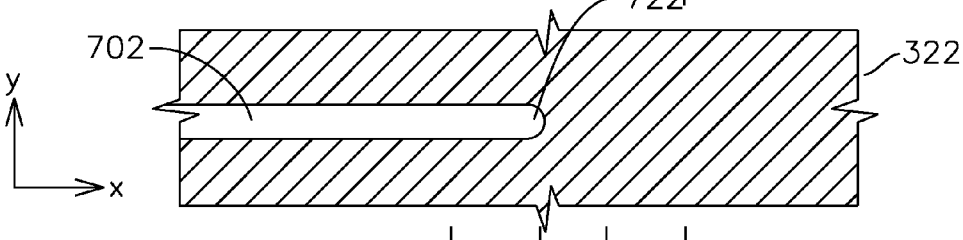
FIGS. 7A, 7B, 7C, and 7D show various section views of FIG. 7.
Figure 7B:
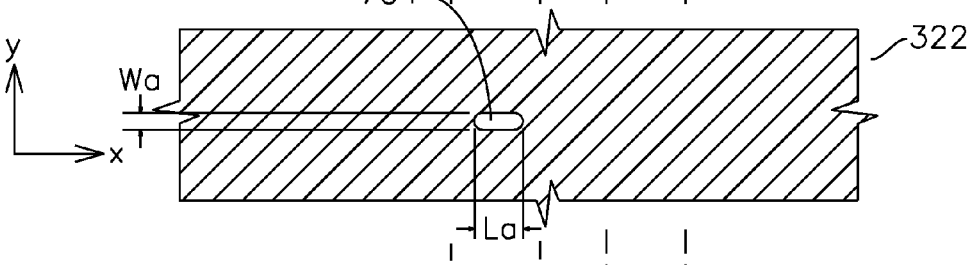

FIG. 7 shows a feedthrough 710 and jog 712 used in beam port length equalization region 312 and array port length equalization region 326 of FIG. 3. Feedthrough 710 and jog 712 are formed from first plate 324, second plate 322, and third plate 320, as shown in section views of 7A, 7B, 7C, and 7D. Feedthrough 710 is formed from array port or beam port waveguide 702 with is formed from first plate 324 and second plate 322. A coupling aperture 704 enables the wave energy to couple from outer waveguide 702 to inner waveguide 706, which is then provided with a jog waveguide 712 which offsets inner waveguide 706 to a z axis location which is symmetric about the second layer interface between second layer 322 and third layer 320. The feedthrough aperture 704 has a width Wa which is less than the waveguide width Ww for either the first waveguide 702 or second waveguide 706 located on either side of the feedthrough aperture 704. Additionally, the first waveguide has a terminus 722 (shown in FIG. 7A) which is located more than 2 wavelengths from the aperture 704, while the second waveguide has a terminus 724

Figure 7C:
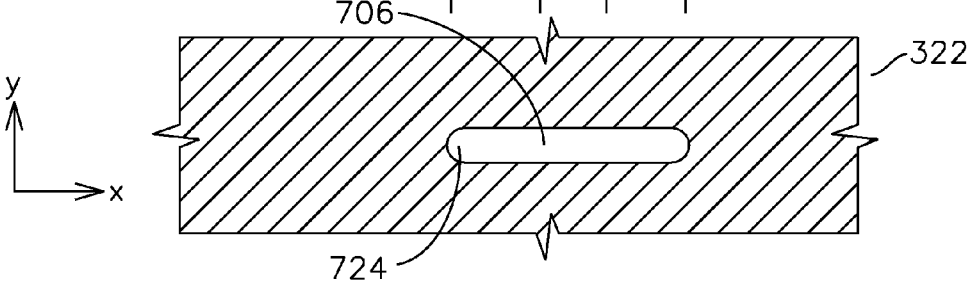
Figure 7D:
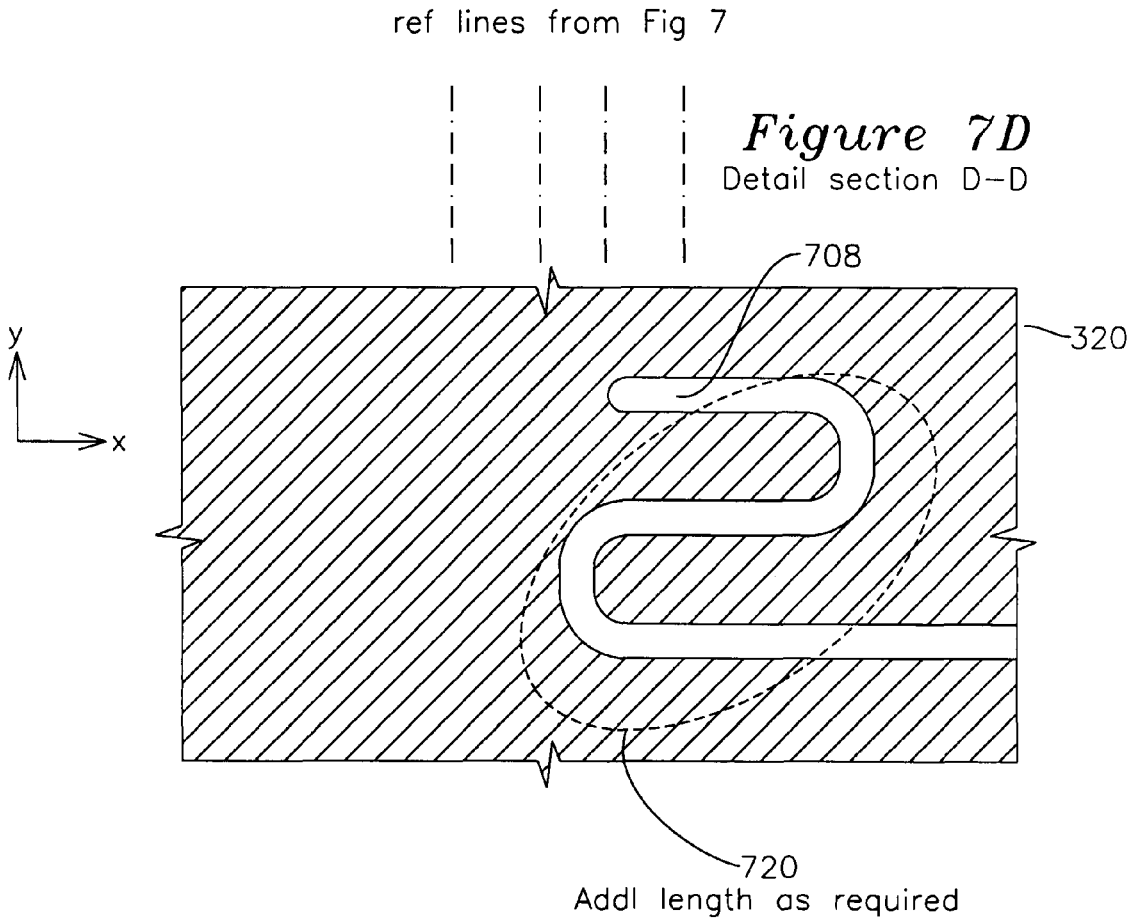

(shown in FIG. 7C) which is more than 2 wavelengths from aperture 704 and located on the opposite side of the terminus of the first waveguide. As was described earlier for the beam port waveguides and array port waveguides, the equalization of length and incorporation of Rotman W parameters in the array port waveguides may be accomplished by a series of length-adding serpentine bends 720.

We claim:

1. A beam forming lens having:

a first plurality of beam port waveguides having a waveguide height Wh1 sufficient to support TE10 modes;

a second plurality of array port waveguides having a waveguide height sufficient to support TE10 modes;

a plurality of dummy ports;

a parallel plate lens region having a height Wh2 sufficient to support at least TE10 and TE20 modes;

said first plurality of beam port waveguides coupled to said parallel plate lens region with a plurality of beam port apertures, whereby each said beam port waveguide is coupled to a beam port divider, said beam port divider comprising a first divider with a first port coupled to said beam port waveguide and a pair of second ports formed from said first port with a resistive septum, each said first divider second ports coupled to a second divider having a first port coupled to one of said first divider second ports, each said second divider second ports coupled to one of said beam port apertures of said parallel plate lens region;

said second plurality of array port waveguides coupled to said parallel plate lens region with a plurality of array port apertures opposite from said first plurality of beam port apertures, said array port waveguides each coupled to a transformer including a waveguide height increase and a divider including a resistive septum forming two ports coupled with apertures to said parallel plate lens region;

said beam port apertures and said array port apertures separated on each end by said plurality of dummy ports.

2. The beam forming lens of claim 1 whereby said lens region has a height which is more than 1.8 times the height of either said beam port waveguide or said array port waveguide.

3. The beam forming lens of claim 1 whereby said lens region has a height which supports TE10 and TE20 modes but does not support TE30 or higher modes.

4. The beam forming lens of claim 1 whereby said beam port divider said first divider includes a step change in height over the extent of said resistive septum.

5. The beam forming lens of claim 1 whereby at least one of said resistive septums is formed from a substrate having at least one surface with a resistive film.

6. A beam forming lens having:

a first plurality of beam port waveguides having a waveguide height Wh1 sufficient to support TE10 modes;

a second plurality of array port waveguides having a waveguide height substantially equivalent to said WH1 and sufficient to support TE10 modes;

a plurality of dummy ports;

a parallel plate lens region having a height Wh2 sufficient to support at least TE10 and TE20 modes, but not TE30 modes;

said first plurality of beam port waveguides coupled to said parallel plate lens region with a plurality of beam port apertures;

said second plurality of array port waveguides coupled to said parallel plate lens region with a plurality of array port apertures opposite from said first plurality of beam port apertures, said array port waveguides each coupled to a transformer including a waveguide height increase to a value greater than said Wh1 and a divider including a resistive septum forming two ports coupled with apertures to said parallel plate lens region;

said beam port apertures and said array port apertures separated on each end by said plurality of dummy ports.

7. The beam forming lens of claim 6 where said Wh2 is less than $3\lambda/2$, where $\lambda$ is the wavelength of microwaves traveling in the lens.

8. The beam forming lens of claim 6 where said Wh2 is the largest value which supports TE20 mode but does not support TE30 mode.

9. The beam forming lens of claim 6 where said Wh1 is less than Wh2/(1.8).

10. A beam forming lens having:

a first plate having a substantially planar surface;

a second plate having at least parts of one surface in contact with said first plate planar surface, thereby forming a first plane, said second plate also having a substantially planar surface on the opposite side of said second plate first plane;

a third plate having at least parts of one surface in contact with said opposite side of said second plate, thereby forming a second plane;

a plurality of beam port dividers, array port dividers, dummy ports, and a lens region formed from said second plate and said third plate, said beam port dividers, said array port dividers, and said dummy ports having apertures coupled to said lens region;

a plurality of waveguides formed from said first and said second plate and leading to an edge of said first and said second plates, each said waveguide coupled to a feedthrough waveguide formed from said first, said second, and said third plates, said feedthrough waveguide coupled to a jog waveguide formed from said second plate and said third plate and coupled to said beam port dividers, and thereafter coupled to either one of said array port dividers or to one of said beam port dividers;

whereby said lens region has a height greater than 1.8 times the height of at least one of said waveguides.

11. The lens of claim 10 where said beam port dividers, said array port dividers, said dummy ports, and said lens region are formed substantially symmetrically about said the joint between said second plate and said third plate.

12. The lens of claim 10 where said waveguides are formed substantially symmetrically about the joint between said first plate and said second plate.

13. The lens of claim 10 where said lens region has a height which is greater than at least one said waveguide height by a factor of 1.8.

14. The lens of claim 10 where said lens region supports TE10 and TE20 modes, and at least one said waveguide supports TE10 mode but not TE20 mode.

15. The lens of claim 10 where said lens region has a height which supports TE10 and TE20 modes but not TE30 modes, and at least one said waveguide supports TE10 mode but not TE20 mode.

16. An array port divider for a beam forming lens, the array port divider accepting power from a first waveguide having a height Hw and coupling power into a lens region having a height Hf greater than Hw, the array port divider having, in sequence:

a first transformer coupled to said waveguide, said first transformer including a transition step height change to a value between said Hw and said Hf;

a second waveguide of said Hf height;

a resistive septum located at substantially the midline of said second waveguide and thereby coupling power to a first aperture waveguide and a second aperture waveguide, said first aperture waveguide and said second aperture waveguide having a height of substantially said Hf and coupled to said lens region.

17. A beam port divider for a beam forming lens, the beam port divider accepting power from a first waveguide having a height Hw and coupling power into a lens region having a height Hf greater than Hw, the beam port divider having, in sequence:

a first power divider including a resistive septum located substantially in the midline of said first waveguide and thereby forming a pair of first divider outputs, said first power divider height changing to said Hf during the extent of said resistive septum;

a pair of second dividers, each said second divider coupled to one of said first power divider outputs through a waveguide of height said Hf, each said second divider including a resistive septum located substantially at the midline of said waveguide, thereby forming a pair of second divider ports, said second divider ports coupled to said lens region.

18. A dummy port for a beam forming lens, the dummy port coupled to a parallel plate lens region including a parallel plate separation Wh2, said dummy port comprising:

an aperture having a height Wh and coupled to said parallel plate lens region;

a first loss element placed substantially parallel to one of said parallel plates and at a separation distance from said parallel plate;

a second loss element placed substantially parallel to the other said parallel plate and at a separation distance from said other parallel plate.

19. The dummy port of claim 18 where at least one of said first loss element separation distance or said second loss element separation distance is in the range ⅛ to ⅓ of said Wh2.

20. The dummy port of claim 18 where said parallel plate lens region supports TE10 and TE20 modes, but not TE30 mode.

21. The dummy port of claim 18 where said first loss element separation distance and said second loss element separation distance provide maximum attenuation of TE20 compared to the attenuation, of TE10.

22. A feedthrough coupler for TE mode waves having a wavelength, the feedthrough coupler having:

a first waveguide having a height Wh and a width Ww and located in a first planar region, said first waveguide Wh sufficient to support TE10 mode;

a second waveguide having said height Wh and said width Ww, said second waveguide located in a second planar region, said second waveguide Wh sufficient to support TE10 mode, and said first planar region and said second planar region being mutually exclusive;

an aperture located between said first planar region and said second planar region and coupling energy from said first waveguide to said second waveguide, said aperture having a width Wa which is less than said Ww, said Wa being less than one said wavelength, said aperture also having a length La which is greater than one said wavelength and perpendicular to either said first or said second waveguide height Wh and also perpendicular to said first or second waveguide width Ww;

said first waveguide having a terminus located beyond said aperture by a length greater than two said wavelengths;

said second waveguide having a terminus located beyond said aperture by a length greater than two said wavelengths.

* * * * *